United States Patent [19]

Iliuta

[11] Patent Number: 5,018,730

[45] Date of Patent: May 28, 1991

[54] GOLF BALL CUP EJECTING APPARATUS

[76] Inventor: Radu Iliuta, Tenstavagen 94BV, 163 65 Spanga, Sweden

[21] Appl. No.: 559,672

[22] Filed: Jul. 23, 1990

[51] Int. Cl.[5] ..... A63B 57/00

[52] U.S. Cl. ..... 273/34 A; 273/179 A

[58] Field of Search ..... 273/34 R, 34 A, 34 B, 273/179 R, 179 A, 179 B, 179 C, 179 D, 179 E, 182 R, 181 C

[56] References Cited

U.S. PATENT DOCUMENTS 3,874,665 4/1975 McCulloch et al. ..... 273/34 A

*Primary Examiner*—George J. Marlo

*Attorney, Agent, or Firm*—Leon Gilden

[57] ABSTRACT

An elongate cylindrical aligned housing includes a solenoid organization operative through an audibly actuated switch to effect ejection of a golf ball directed within the organization by an individual effecting an audible sound system such as a clapping noise above the apparatus to effect actuation of the magnetic coil of the solenoid to effect displacement of a ram slidably mounted therewithin.

4 Claims, 3 Drawing Sheets

PRIOR ART

GOLF BALL CUP EJECTING APPARATUS

BACKGROUND OF THE INVENTION

1. Field of the Invention

The field of invention relates to golf apparatus, and more particularly pertains to a new and improved golf ball cup ejecting apparatus wherein the same permits selective actuation of the organization to effect ejection of a golf ball within the cup structure.

2. Description of the Prior Art

The prior art has utilized selectively actuatable golf ball ejecting cup structure, but has heretofore failed to provide the easily actuated organization set forth by the instant invention utilizing an audible switch to effect actuation of the magnetic coil and vertical deflection of a coaxially oriented ram to effect ejection of a golf ball within the cup structure. Examples of the prior art include U.S. Pat. No. 3,874,665 to McCullough, et al wherein a telescoping coil and magnet system is operative upon deflecting of a golf ball into a cup overlying the magnetic system to effect telescoping of a sleeve to effect displacement of the golf ball from within the cup organization.

U.S. Pat. No. 3,792,861 to Coleman sets forth a ball ejecting member wherein a mechanical downward displacement of the ball support effects subsequent displacement of the golf ball by upward displacement of the ball support organization.

U.S. Pat. No. 4,552,358 to McGlew sets forth a golf ball ejector wherein a pull directed within fluid pressure cylinder adjacent the cup structure effects simultaneous displacement of the golf ball from within the cup structure.

U.S. Pat. No. 4,290,603 to Barnes sets forth a golf ball cup ejector structure utilizing a spring biased plunger to effect displacement of the golf ball from the cup.

As such, it may be appreciated that there continues to be a need for a new and improved golf ball cup ejecting apparatus wherein the same addresses both the problems of ease of use as well as effectiveness in construction and in this respect, the present invention substantially fulfills this need.

SUMMARY OF THE INVENTION

In view of the foregoing disadvantages inherent in the known types of golf ball cup ejecting apparatus no present in the prior art, the present invention provides a golf ball cup ejecting apparatus wherein the same utilizes an audibly actuated switch to effect displacement of a golf ball from within a golf ball cup structure. As such, the general purpose of the present invention, which will be described subsequently in greater detail, is to provide a new and improved golf ball cup ejecting apparatus which has all the advantages of the prior art golf ball cup ejecting apparatus and none of the disadvantages.

To attain this, the present invention provides an elongate cylindrical aligned housing including a solenoid organization operative through an audiby actuated switch to effect ejection of a golf ball directed within the organization by an individual effecting an audible sound system such as a clapping noise above the apparatus to effect actuation of the magnetic coil of the solenoid to effect displacement of a ram slidably mounted therewithin.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf ball cup ejecting apparatus which has all the advantages of the prior art golf ball cup ejecting apparatus and none of the disadvantages.

It is another object of the present invention to provide a new and improved golf ball cup ejecting apparatus which may be easily and efficiently manufactured and marketed.

It is a further object of the present invention to provide a new and improved golf ball cup ejecting apparatus which is of a durable and reliable construction.

An even further object of the present invention is to provide a new and improved golf ball cup ejecting apparatus which is susceptible of a low cost of manufacture with regard to both materials and labor, and which accordingly is then susceptible of low prices of sale to the consuming public, thereby making such golf ball cup ejecting apparatus economically available to the buying public.

Still yet another object of the present invention is to provide a new and improved golf ball cup ejecting apparatus which provides in the apparatuses and methods of the prior art some of the advantages thereof, while simultaneously overcoming some of the disadvantages normally associated therewith.

Still another object of the present invention is to provide a new and improved golf ball cup ejecting apparatus wherein the same permits selective displacement and ejection of a golf ball within a golf ball cup structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
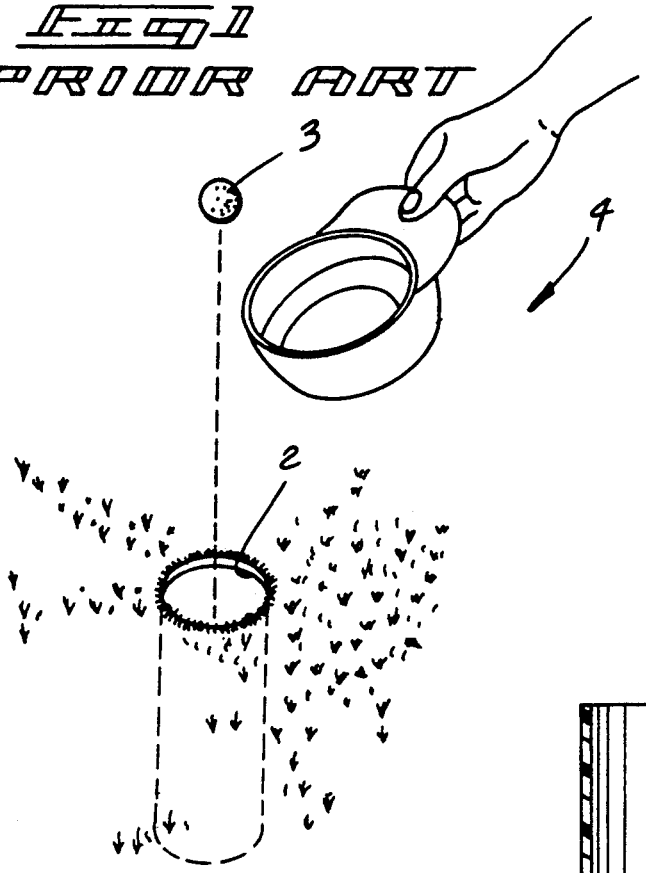
FIG 1 PRIOR ART
FIG. 1 is an isometric illustration of a prior art golf ball cup ejecting cup organization.

With reference now to the drawings, and in particular to FIGS. 1 to 6 thereof, a new and improved golf ball cup ejecting apparatus embodying the principles and concepts of the present invention and generally designated by the reference numeral 10 will be described.

Figure 2:
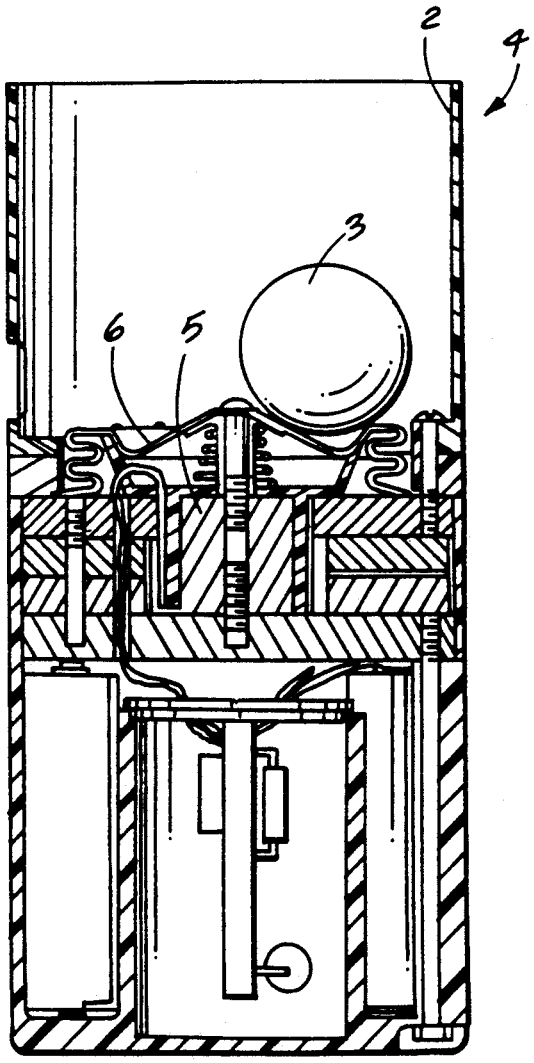
FIG. 2 is an orthographic cross-sectional view of a prior art golf ball cup ejecting apparatus of a type as typified by FIG. 1.

FIG. 1 is an isometric illustration of a typical prior art golf ball cup ejecting apparatus, wherein an interior cavity 2 displaces a golf ball 3 from within the cup, wherein the structure 4 is further illustrated in FIG. 2 by way of example of a type as set forth in U.S. Pat. No. 3,874,665, wherein the golf ball 3 upon positioning upon a golf ball ejecting cup member 6 effects actuation by an associated electric magnetic member 5 to effect displacement and upward positioning of the golf ball cup structure 6, in a manner as set forth in U.S. Pat. No. 3,874,665.

Figure 3:
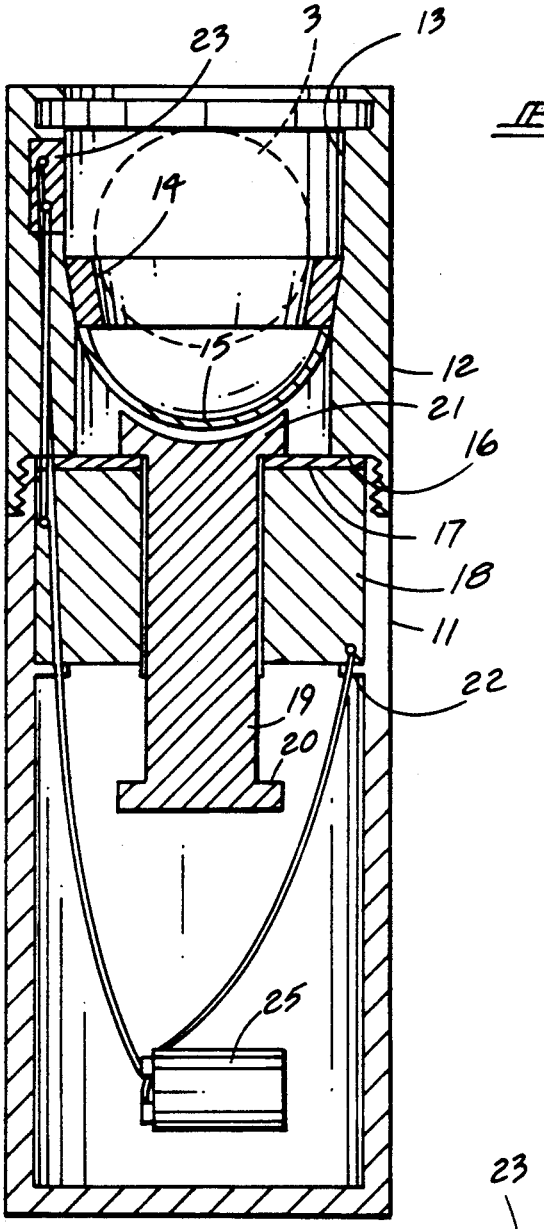
FIG. 3 is an orthographic cross-sectional illustration of the golf ball cup structure of the instant invention.
Figure 4:
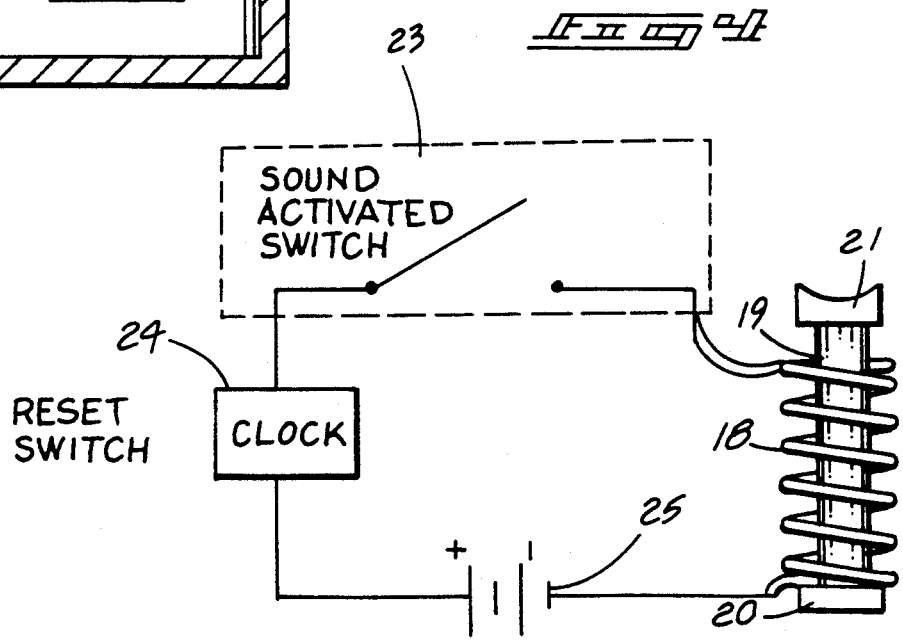
FIG. 4 is a diagrammatic illustration of the electrical circuit utilized by the instant invention.
Figure 5:
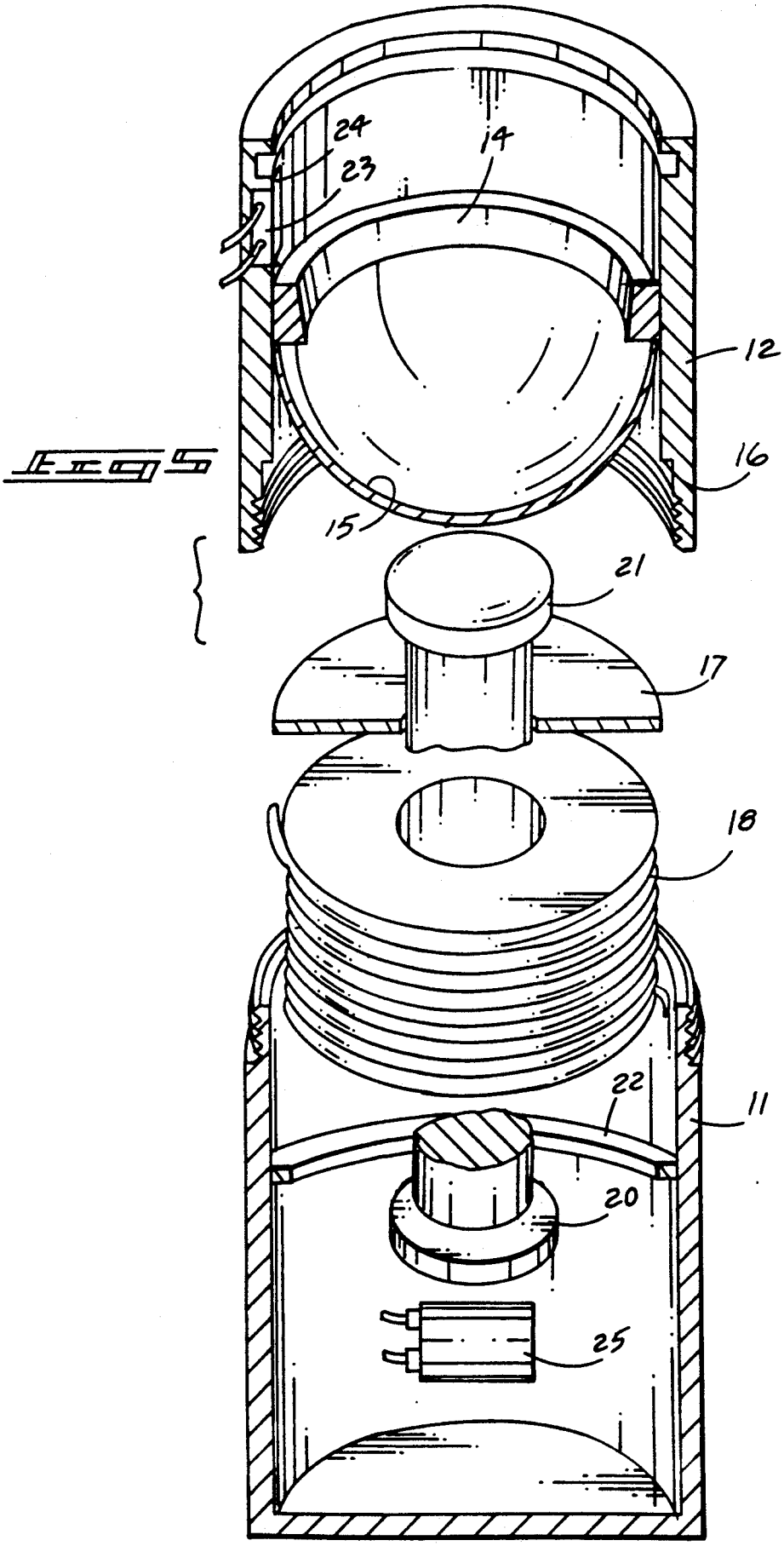
FIG. 5 is an isometric illustration, somewhat exploded and partially in section, of the golf ball cup ejecting apparatus of the instant invention.

More specifically, the golf ball cup ejecting apparatus 10 of the instant invention essentially comprises a lower cylindrical housing 11 coaxially and selectively securable to an upper cylindrical housing 12 coaxially aligned with the lower cylindrical housing by inter-engaging threads, in a manner as illustrated in FIG. 3. A cylindrical entrance opening 13 of a first diameter includes an abutment ring 14 of a generally conical interior surface 14 positioned within the cylindrical entrance opening 13 below an upper end thereof, wherein the conical interior surface defined by a second diameter less than that of the ball diameter of the golf ball 3, and wherein the golf ball 3 is defined by a golf ball diameter less than that of the entrance opening 13. A flexible diaphragm 15 is fixedly mounted within the entrance opening 13 underlying the abutment ring 14 and overlying a ram 19, as illustrated. The ram 19 is coaxially positioned medially of an electro-magnetic coil 18 of a generally cylindrical configuration, including a central cylindrical opening complementarily and slidingly receiving the ram 19 therewithin. The upper housing 12 includes an upper housing annular abutment surface 16 radially disposed within the upper housing and providing an abutment surface for an abutment plate 17 that coextensively overlies an upper planar surface of the electro-magnetic coil 18. The electro-magnetic coil 18 is mounted in a fixed relationship within the lower housing 11 and is positionable upon a lower housing abutment flange 22 that is spaced below the upper housing abutment surface 16 a predetermined height substantially equal to that of the predetermined height defined by the electro-magnetic coil 18 and the abutment plate 17 to capture the electro-magnetic coil and associated ram 19 between the upper housing 12 and the lower housing 11 when the upper housing 12 is threadedly secured to the lower housing 11. The ram 19 includes an annular lower ram flange 20 defined by a lower ram flange diameter greater than that defined by the ram 19 to prevent displacement of the lower flange 20 through the electro-magnetic coil 18. An annular ram flange 21 is integrally and orthogonally arranged relative to the axis of the ram flange 19 parallel to the lower ram flange 20 and is formed with a semi-spherical concave recess complementary to that defined by the golf ball 3, whereupon actuation of the electro-magnetic coil 18 effects displacement of the ram 19 upwardly to thereafter effect displacement of the diaphragm 15 upwardly to contact a lower surface of the golf ball 3 and effect ejection of the golf ball 3 from within the entrance opening 13. The electro-magnetic coil 18 defining a solenoid operation is actuated through a sound activated switch, including a timed reset switch 24, whereupon upper telescoping of the ram 19 relative to the coil 18 is reset to effect deactivation of the coil 18 upon a predetermined time delay. Such switches are per se known in the prior art, but whose synergistic combination with the instant invention provides a convenient and selectively actuatable ejection organization as set forth. A battery 25 provides electrical energy for use in actuation of the electro-magnetic coil 18 when required, wherein a single or a plurality of such batteries may be utilized. Access to the batteries are permitted by threadedly removing the upper housing 12 relative to the lower housing 11, whereupon removal of the electro-magnetic coil from the lower housing abutment flange 22 permits access to the battery member 25 for replacement and servicing thereof.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A golf ball cup ejecting apparatus for use in ejecting a golf ball received within the apparatus, wherein the golf ball is defined by a golf ball diameter and wherein the apparatus comprises, a lower housing, and an upper housing coaxially aligned with and selectively securable to said lower housing, the upper housing including an entrance opening defined by a first diameter greater than the golf ball diameter, and wherein the entrance opening includes an upper terminal end and further includes an abutment ring formed within the entrance opening spaced below the upper terminal end, wherein the abutment ring is defined by an internal conical surface, wherein the abutment ring is defined by an opening less than that defined by the golf ball diameter to support the golf ball within the entrance opening, and the lower housing having associated therewith means including an audibly actuated switch means for selectively actuating an electromagnetic means, including a ram in said lower housing to effect vertical and upper displacement of the ram to effect selective displacement of the golf ball from within the abutment ring.

2. An apparatus as set forth in claim 1 wherein the electromagnetic means is mounted within the lower housing, the lower housing defined by a lower cylindrical housing and the upper housing defined by an upper cylindrical housing, wherein the upper and lower cylindrical housings are coaxially aligned with the lower cylindrical housing threadedly securable to the upper cylindrical housing, and the upper cylindrical housing including a radially disposed upper housing abutment surface, and the lower housing including a radially disposed upper housing abutment flange, wherein the lower housing abutment flange is spaced below the upper housing abutment surface a predetermined height, and the electromagnetic means includes an electro-magnetic coil defined by a height equal to the predetermined height.

3. An apparatus as set forth in claim 2 wherein the ram is defined by a ram height greater than the predetermined height, and the ram includes a lower annular flange fixedly mounted to a lower terminal end of the ram, and the ram further includes an upper annular flange mounted to an upper end of the ram, wherein the upper and lower flange are spaced generally parallel relative to one another and the upper flange includes a semispherical concave recess formed in an upper surface of the upper flange, and said audibly actuated switch means being mounted within the upper housing, and a battery mounted within a lower housing, wherein the battery is electrically associated with the electromagnetic coil through the audible switch means, whereupon actuation of the audible switch means effects vertical upper displacement of the ram relative to the electro-magnetic coil, and the audible switch further includes a reset switch to effect deactuation of the electro-magnetic coil after a predetermined time.

4. An apparatus as set forth in claim 3 further including a flexible diaphragm mounted within the entrance opening between the abutment ring and the ram.

* * * * *